US007513116B2

(12) United States Patent
Hebert et al.

(10) Patent No.: US 7,513,116 B2
(45) Date of Patent: Apr. 7, 2009

(54) GAS TURBINE ENGINE FUEL INJECTOR HAVING A FUEL SWIRLER

(75) Inventors: John A. Hebert, Fennville, MI (US); Douglas A. Diemer, Zeeland, MI (US)

(73) Assignee: Woodward FST, Inc., Zeeland, MI (US)

( * ) Notice: Subject to any disclaimer, the term of this patent is extended or adjusted under 35 U.S.C. 154(b) by 425 days.

(21) Appl. No.: 10/984,951

(22) Filed: Nov. 9, 2004

(65) Prior Publication Data

US 2006/0096291 A1 May 11, 2006

(51) Int. Cl.
*F02C 1/00* (2006.01)
*F02G 3/00* (2006.01)

(52) U.S. Cl. ..... 60/748; 60/740

(58) Field of Classification Search ..... 60/740, 60/742, 748; 239/399, 403, 533.2
See application file for complete search history.

(56) References Cited

U.S. PATENT DOCUMENTS

| | | | | | |
|---|---|---|---|---|---|
| 1,516,397 | A | | 11/1924 | Mueller et al. | |
| 2,528,665 | A | | 11/1950 | Peterson et al. | 309/2 |
| 3,013,732 | A | | 12/1961 | Webster et al. | 239/404 |
| 3,717,305 | A | | 2/1973 | Hedges | 239/288.5 |
| 4,111,369 | A | | 9/1978 | Sharpe | 239/400 |
| 4,139,160 | A | | 2/1979 | Rood | 239/600 |
| 4,491,272 | A | * | 1/1985 | Bradley et al. | 239/5 |
| 4,951,874 | A | * | 8/1990 | Ohnishi et al. | 239/88 |
| 5,199,649 | A | | 4/1993 | Tolboll | 239/600 |
| 5,716,009 | A | | 2/1998 | Ogihara et al. | 239/533.12 |
| 5,862,995 | A | | 1/1999 | Wu | 239/533.2 |
| 6,076,356 | A | * | 6/2000 | Pelletier | 60/740 |
| 6,116,522 | A | | 9/2000 | Kampichler | 239/533.2 |
| 6,351,948 | B1 | * | 3/2002 | Goeddeke | 60/740 |
| 6,378,792 | B2 | | 4/2002 | Fukaya et al. | 239/533.12 |
| 6,412,272 | B1 | | 7/2002 | Titterton, III et al. | 60/39.37 |
| 6,547,163 | B1 | * | 4/2003 | Mansour et al. | 239/404 |
| 6,655,145 | B2 | | 12/2003 | Boardman | 60/737 |
| 6,688,534 | B2 | | 2/2004 | Bretz | 239/8 |
| 6,755,024 | B1 | * | 6/2004 | Mao et al. | 60/776 |
| 6,968,692 | B2 | * | 11/2005 | Chin et al. | 60/737 |
| 2003/0146301 | A1 | * | 8/2003 | Sun et al. | 239/399 |
| 2004/0003596 | A1 | * | 1/2004 | Chin et al. | 60/737 |
| 2007/0157616 | A1 | * | 7/2007 | Hernandez et al. | 60/740 |
| 2007/0163263 | A1 | * | 7/2007 | Thomson | 60/773 |
| 2007/0193272 | A1 | * | 8/2007 | Hebert et al. | 60/740 |

FOREIGN PATENT DOCUMENTS

| | | |
|---|---|---|
| EP | 0 799 991 | 10/1997 |
| JP | 63172064 | 7/1988 |
| JP | 10025616 | 1/1998 |
| WO | 00/00770 | 1/2000 |

* cited by examiner

*Primary Examiner*—William H Rodriguez

(57) ABSTRACT

A fuel injector for a gas turbine engine includes a support member and a nozzle tip disposed on the support member with a deformable, removable metallic or non-metallic seal member disposed between facing sealing surfaces of the support member and a shroud member of the nozzle tip. The deformable seal member includes one or more fuel passages through which fuel in one or more fuel circuits flows with the seal member sealingly separating the first and second fuel circuits and preventing external fuel leakage from the nozzle tip. The nozzle tip can include an inner fuel swirler that includes one or more swirler slots wherein each slot is so angled in an axial direction toward the discharge orifice of the nozzle tip assembly that operation of the nozzle tip assembly is unaffected by changes in fuel viscosity.

23 Claims, 6 Drawing Sheets

FIG. 2
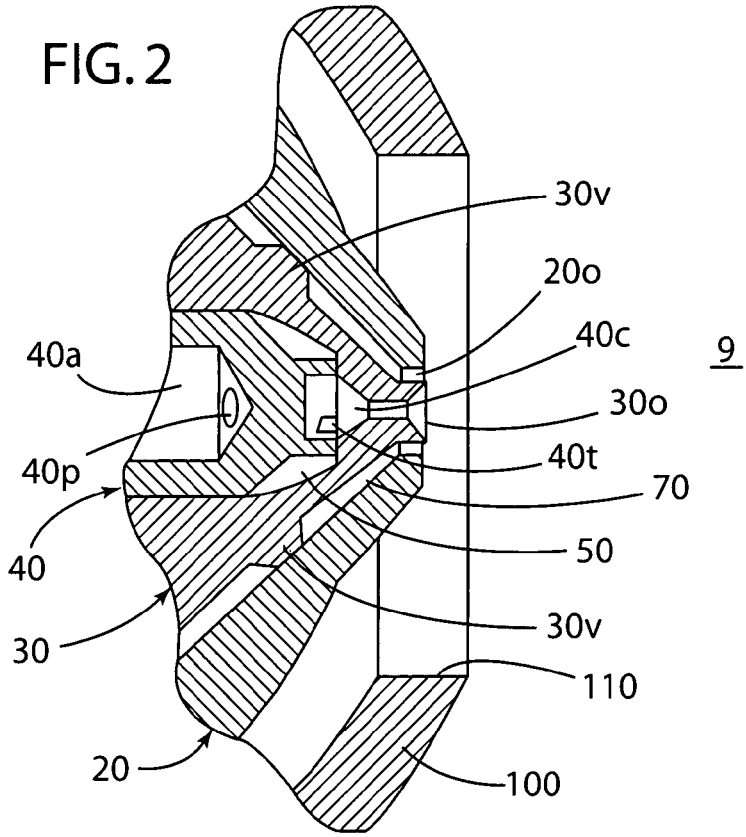
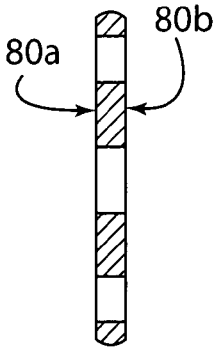
FIG. 3B
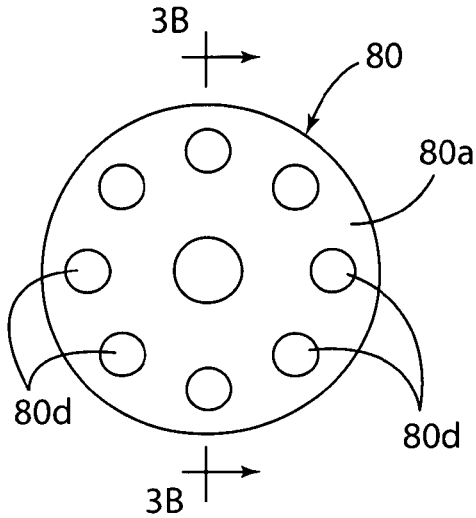
FIG. 3A
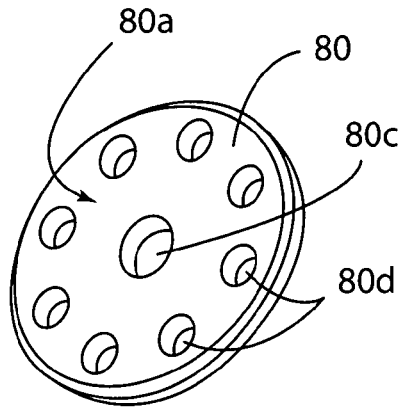
FIG. 3C

GAS TURBINE ENGINE FUEL INJECTOR HAVING A FUEL SWIRLER

FIELD OF THE INVENTION

The present invention relates to a fuel injector for injecting fuel to the combustor of a gas turbine engine.

BACKGROUND OF THE INVENTION

A gas turbine engine includes a combustor in which fuel is discharged by a plurality of fuel injectors for combustion in a manner well known. Fuel injectors can be of the pressure-atomizing type, air blast type, and hybrid pressure-atomizing/air blast type. Regardless of the type of fuel injector, each fuel injector typically includes a nozzle tip that includes one or more fuel discharge orifices through which the fuel is introduced into the combustor.

The fuel nozzle assembly is usually brazed, welded, or otherwise mechanically attached to a support member, such as support strut. If the fuel nozzle includes dual fuel circuits (e.g. two separate fuel circuits such as primary fuel and secondary fuel circuits), leakage between the fuel circuits is generally not permitted. As a result, most fuel nozzles incorporate one or more braze or weld joints between nozzle tip components to separate the two fuel circuits. For example, U.S. Pat. No. 6,351,948 describes a pressure-atomizing fuel injector including a primary fuel circuit separated from a secondary fuel circuit by such joints.

SUMMARY OF THE INVENTION

The present invention provides in an illustrative embodiment a fuel injector for a gas turbine engine wherein a support member and a nozzle tip are connected with a deformable, removable seal member disposed in sealing relation between a sealing surface of the support member and a facing sealing surface of a shroud member of the nozzle tip. The seal member includes one or more fuel passages through which fuel of one or more fuel circuits flows. The seal member sealingly separates the fuel circuits from one another in the nozzle tip when multiple fuel circuits are present, while at the same time sealing the fuel circuits from external leakage from the nozzle tip. The seal member is received with peripheral clearance in the shroud member so as to be a close tolerance fit therein for ready removal from the nozzle tip. Likewise, an inner nozzle body and swirler body may be present as part of the nozzle tip and are a close tolerance fit within the shroud member for ready removal from the nozzle tip. The inner nozzle body and fuel swirler body each has a sealing surface substantially coplanar with the sealing surface of the shroud member for sealing engagement with the metallic seal member to sealingly separate the fuel circuits.

The deformable, removable seal member preferably is made of a metallic material although the seal member can be made of a non-metallic material or a combination of metallic and non-metallic materials as well that can withstand the seal operating temperature to be encountered.

A fuel injector pursuant to another embodiment of the invention includes a nozzle tip having an inner fuel swirler that includes one or more swirler slots wherein each slot has an angled wall in an axial direction toward the fuel discharge orifice of the nozzle tip such that operation of the nozzle tip is substantially unaffected by changes in fuel viscosity resulting, for example, from changes in fuel temperature. For example, each swirler slot includes an upstream slot wall that converges at an acute angle relative to a longitudinal axis in an axial direction toward the fuel discharge orifice.

Other advantages and features of the invention will become more readily apparent from the following detailed description taken with the following drawings.

DESCRIPTION OF THE DRAWINGS

FIG. 2 is an enlarged partial cross-sectional view of the nozzle tip.

FIG. 3A is a plan view of the deformable metallic seal member. FIG. 3B is a diametral sectional view of the seal member. FIG. 3C is a perspective view of the seal member.

DESCRIPTION OF THE INVENTION

Figure 1:
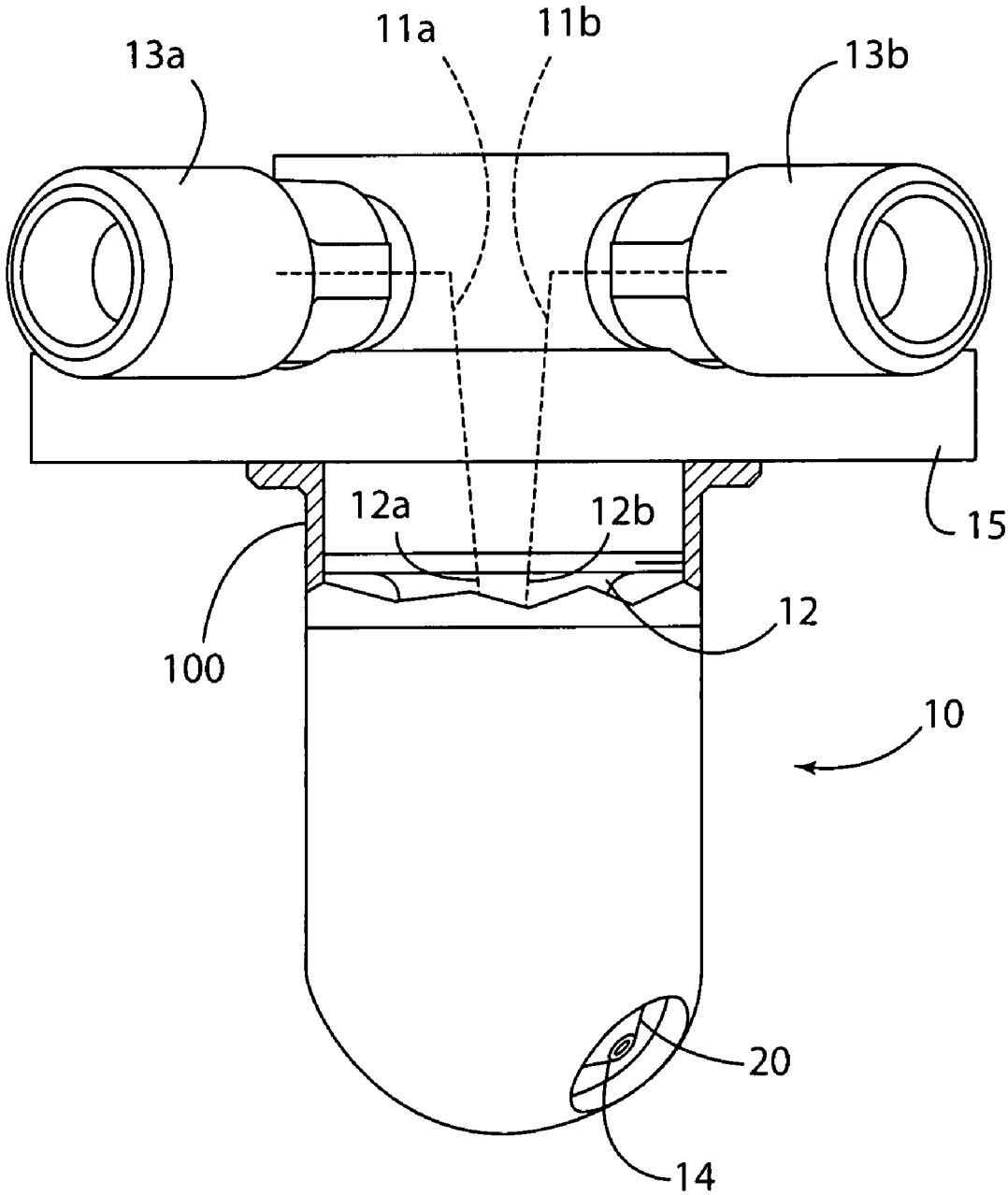
FIG. 1 is an elevational view of a fuel injector pursuant to an embodiment of the invention with the heat shield partially broken away.
Figure 1A:
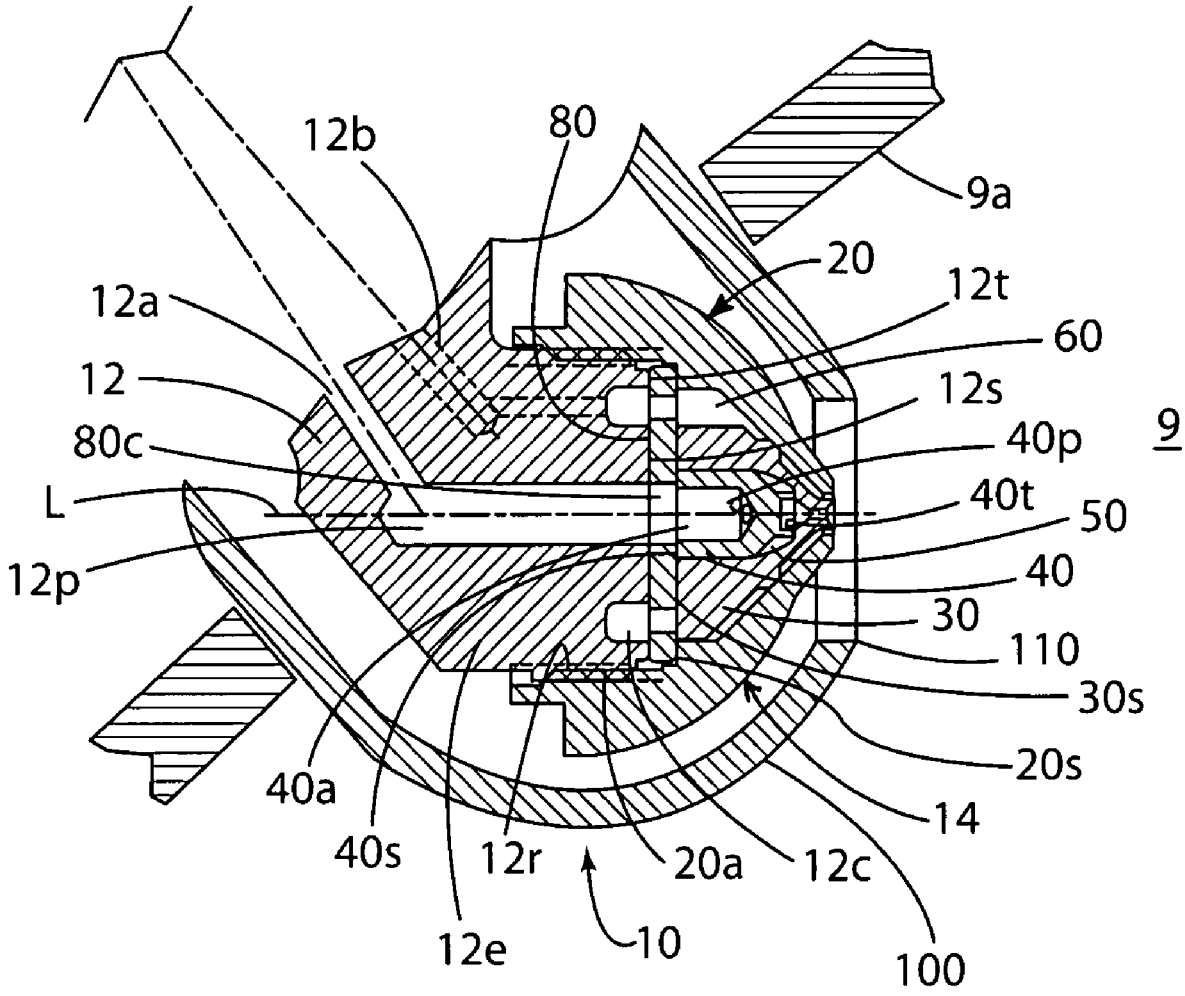
FIG. 1A is a cross-sectional view of a fuel injector pursuant to an embodiment of the invention.

Referring to FIGS. 1, 1A, and 2, a fuel injector 10 pursuant to an illustrative of the invention is shown as a pressure-atomizing fuel injector where fuel pressure is employed to atomize the fuel, although the invention is not limited to a pressure-atomizing fuel injector and can be practiced with other types of gas turbine engine fuel injectors. The fuel injector nozzle tip 14 is adapted to be disposed in an optional heat shield 100 on a wall 9*a* of a combustor 9 of a gas turbine engine. The optional heat shield 100 extends along the length of the support member 12 providing an air space about the support member 12 and forms no part of the invention. The heat shield 100 may be omitted in practice of the invention.

Typically, a plurality of fuel injectors 10 are disposed about the wall 9*a* of the combustor 9. The combustor 9 receives pressurized discharge air from the compressor (not shown) of the gas turbine engine as is well known. The housing 15 of each fuel injector 10 is connected to an engine casing (not shown) or other support as is well known.

The fuel injector 10 includes a support member 12 to which nozzle tip 14 is connected. The support member 12 can comprise a so-called strut member of the type commonly used to support the nozzle tip relative to the combustor as illustrated, for example, in Woodward FST U.S. Pat. No. 6,351,948, the teachings of which are incorporated herein by reference. The support member 12 is shown including first (primary) and second (secondary) fuel supply passages 12*a*, 12*b* when a primary and secondary fuel flow is to be provided to the combustor 12 via the nozzle tip 14. The fuel passages 12*a*, 12*b* receive fuel via respective first and second fuel passages 11*a*, 11*b* (shown schematically as dashed lines) in the housing 15. The fuel passages 11*a*, 11*b* receive fuel via respective first and second inlet fittings 13*a*, 13*b* on injector housing 15. The invention is not limited to the support member 12 described since the invention is not so limited and can be practiced with any other type of support member (strut member) used to support a fuel injector relative to a combustor of a gas turbine engine and providing at least one fuel flow to the combustor. Optionally one or more metering valves (not shown) as illustrated for example in U.S. Pat. No. 6,351,948 can be present to meter the first and second fuel flows to fuel passages 12*a*, 12*b*.

The fuel passage 12*a* supplies fuel to an enlarged central fuel passage 12*p* at the end 12*e* of the support member 12. The fuel passage 12*b* supplies fuel to an annular chamber 12*c* formed in the end 12*e* of the support member. The support member 12 includes a planar, annular sealing surfaces 12*s*, 12*t* on the end 12*e* thereof. As is apparent, the inner sealing surface 12*s* is intersected by the central fuel passage 12*p* and the fuel chamber 12*c*. The outer sealing surface 12*t* is intersected by the fuel chamber 12*c*. The sealing surfaces 12*s*, 12*t* can be formed to final dimension and surface finish by conventional machining processes, such as turning, in practice of the invention without the need for costly secondary finishing operations.

The nozzle tip 14 comprises an outer shroud member 20 that is connected to the support member 12. For example, the shroud member 20 includes internal threads 20*a* by which are threadably connected on threads 12*r* of an outer threaded region of the support member 12 as illustrated in FIG. 1A.

The shroud member 20 includes an annular sealing surface 20*s* that faces the outer sealing surface 12*t* of the support member 12. Sealing surfaces 12*t*, 20*s* are substantially perpendicular to the longitudinal axis L of the nozzle tip 14. The sealing surface 20*s* is formed to final dimension and surface finish by conventional machining processes in practice of the invention without the need for costly secondary finishing operations.

An inner nozzle body 30 is disposed in the shroud member 20 as shown. A fuel swirler body 40 is disposed in the inner nozzle body 30. The fuel swirler body 40 includes a chamber 40*a* for receiving fuel from the central fuel passage 12*p*, a passage 40*p* for supplying the fuel to an annular chamber 50 formed between the swirler body 40 and the inner nozzle body 30 as shown. The fuel flows from the chamber 50 through swirler slots 40*t* (one shown) into a downstream swirler spin chamber 40*c* and then flows through a first fuel discharge orifice 300 of the inner nozzle body into the combustor 9 as a primary fuel flow. The above-described fuel chambers, passages, swirler slots and fuel discharge orifice 300 define a first primary fuel circuit in the nozzle tip 14.

Figure 4:
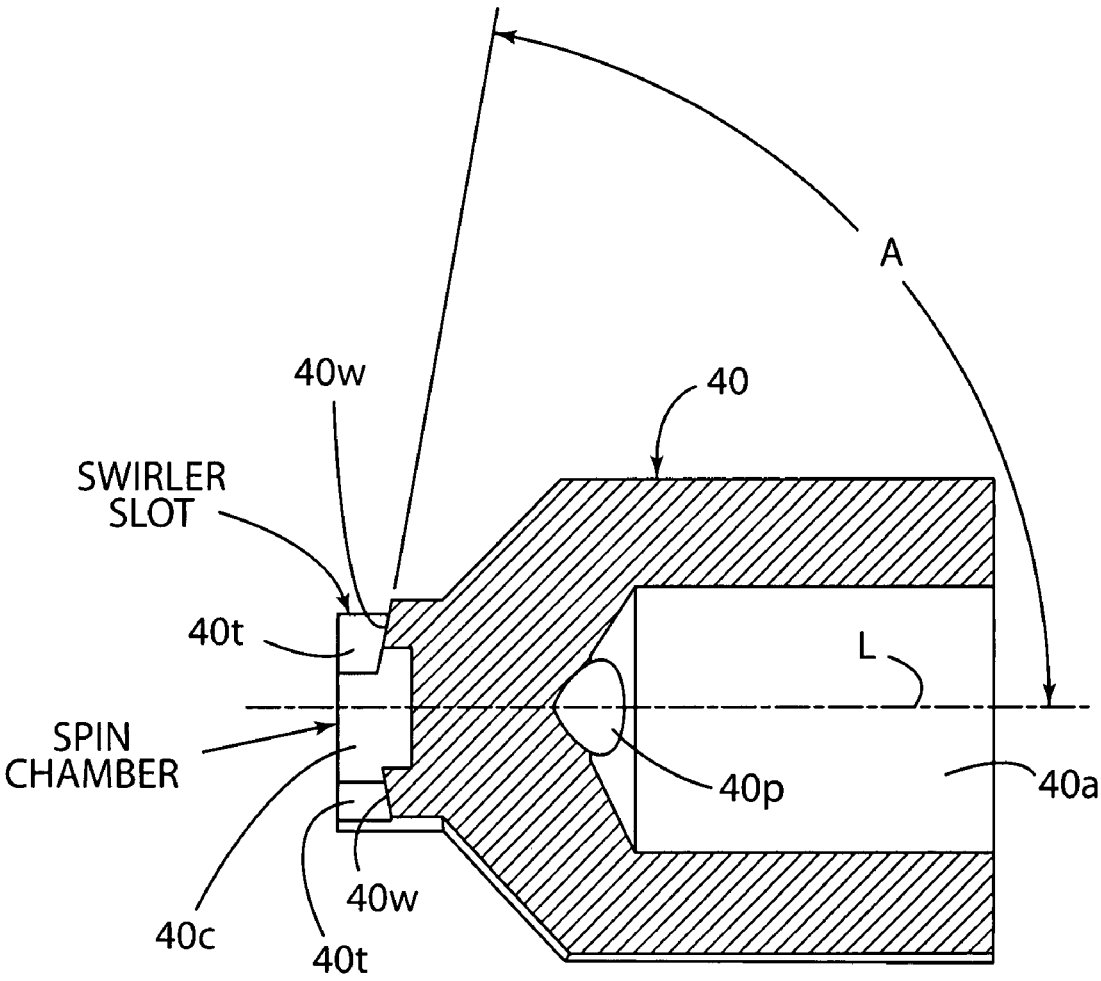
FIG. 4 is an enlarged cross-sectional view of the fuel swirler body wherein the sectional view is taken through the slots as illustrated by lines 4-4 of FIG. 5.
Figure 5:
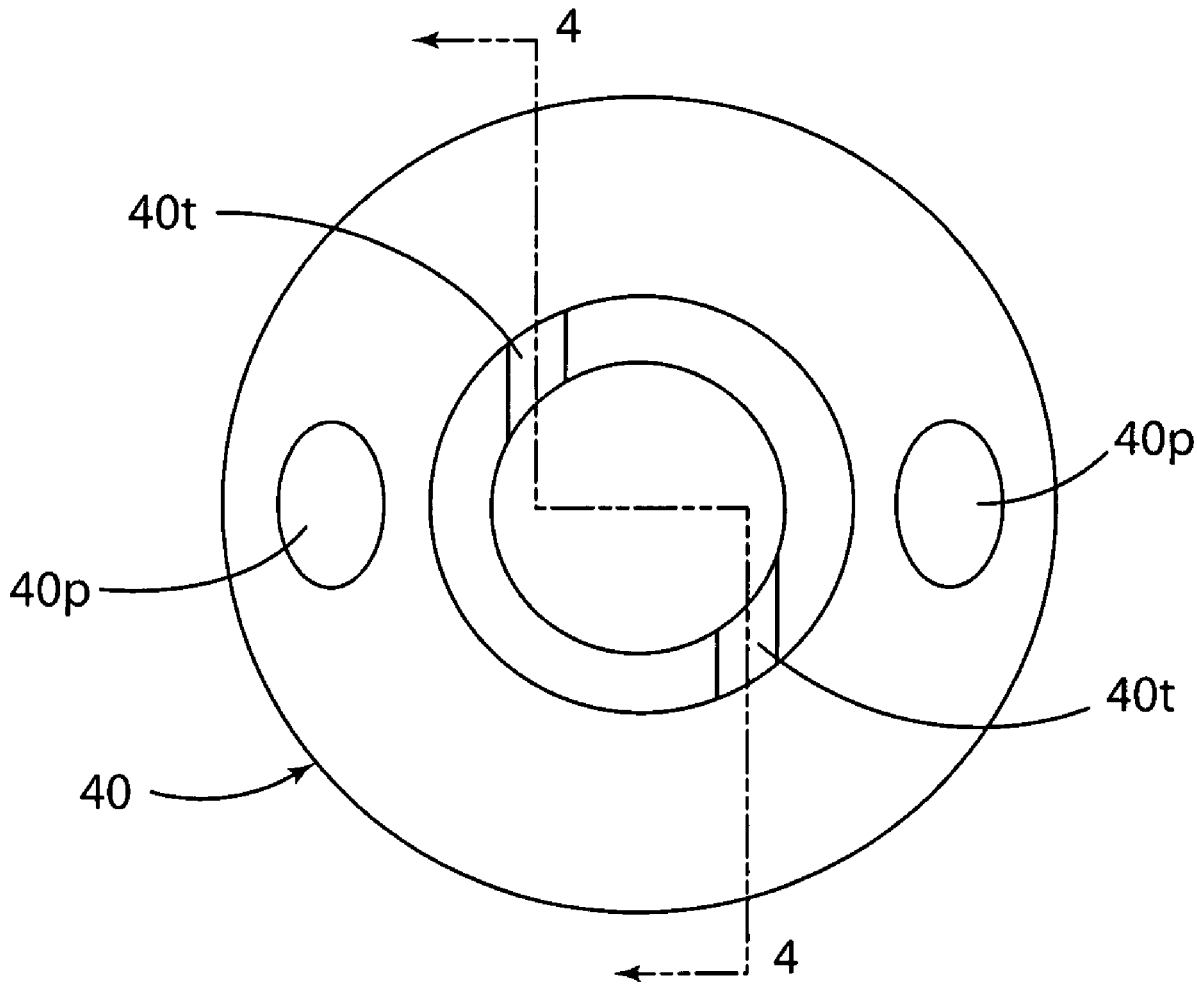
FIG. 5 is an elevational view of the fuel swirler body.

Referring to FIGS. 4 and 5, two swirler slots 40*t* are shown each having an upstream slot wall 40*w* angled as shown to impart axial motion to the fuel flowing into the spin chamber 40*c* pursuant to a further embodiment of the invention. In particular, each swirler slot 40*t* includes an upstream slot wall 40*w* that converges at an acute angle A relative to a longitudinal axis L in an axial direction toward the fuel discharge orifice 300 such that operation of the nozzle tip (e.g. fuel atomization, flow rate and spray angle) is relatively unaffected by changes in fuel viscosity resulting, for example, from changes in fuel temperature. For purposes of illustration and not limitation, each upstream slot wall 40*w* converges at an acute angle A so as to impart an increased amount of axial momentum to the fuel flowing into spin chamber 40*a*. For purposes of illustration and not limitation, the acute angle A can be greater than 0 and less than 90 degrees (e.g. 80 degrees) although other angles can be used in practicing the invention.

The slots 40*t* are offset relative to the center axis of the nozzle to impart swirling motion to the fuel flowing into spin chamber 40*c*. The two swirler slots 40*t* are shown spaced apart peripherally about 180 degrees on the swirler body 40, although the invention is not limited to any particular number or spacing of swirler slots 40*t* (e.g. one or more swirler slots may be present).

A fuel chamber 60 is formed between the inner nozzle body 30 and the shroud member 20 to receive fuel from annular chamber 12*c* of the support member 12. The fuel flows from chamber 60 past swirler vanes 30*v* formed on the inner nozzle body 30 or shroud member 20 and then into the swirl chamber 70 formed between the inner nozzle body 30 and the shroud member 20 downstream of swirl vanes 30*v*. The swirling fuel flows from chamber 70 through a second fuel discharge orifice 20*o* of the shroud member 20 into the combustor 9 as a secondary fuel flow. The above-described fuel chambers, passages and fuel discharge orifice 20*o* define a second secondary fuel circuit in the nozzle tip 14. The discharge orifices 20*o*, 30*o* direct fuel spray cones through an orifice 110 of heat shield 100.

Pursuant to a still further embodiment of the invention, a deformable, removable metallic seal member 80 is sealingly disposed between the sealing surface 12*t* of the support member 12 and the facing sealing surface 20*s* of the shroud member 20 and also between sealing surface 12*s* and sealing surfaces 30*s*, 40*s* of the inner nozzle body 30 and swirler body 40, respectively. The seal member 80 comprises a metallic disk shape having a first major side 80*a* for sealing in relation to sealing surface 12*s*, 12*t* of the support member 12 and second major side 80*b* for sealing in relation to sealing surface 20*s* of the shroud member 20, sealing surface 30*s* of the inner nozzle body 30, and sealing surface 40*s* of the swirler body 40. Sealing surface 20*s* of the shroud member 20, sealing surface 30*s* of the inner nozzle body 30, and sealing surface 40*s* of the swirler body 40 are substantially coplanar so as to be in such sealing relation with the deformable metallic seal member 80.

The metallic seal member 80 includes a first central fuel passage 80*c* that is aligned with the central fuel passage 12*p* and chamber 40*a* so to allow fuel in the first fuel circuit to flow therethrough on its way to the primary fuel discharge orifice 30*o* while sealingly separating the first and second fuel circuits from one another. The metallic seal member 80 also includes multiple (e.g. 8) fuel passages 80*d* that are aligned with the annular fuel chamber 12*c* and fuel chamber 60 so to allow fuel in the second fuel circuit to flow therethrough on its way to the secondary fuel discharge orifice 20*o* while sealingly separating the first and second fuel circuits from one another and sealing the second fuel circuit from external leakage.

The metallic seal member 80 is sealingly compressed between the sealing surfaces 12*s*, 12*t* and sealing surfaces 20*s*, 30*s*, 40*s* when the shroud member 20 is threaded onto the threads 12*r* of the outer threaded region of the support member 12 as illustrated in FIG. 1A. The metallic seal member 80 accommodates any surface irregularities in the sealing surfaces 12*s*, 12*t*, 20*s*, 30*s*, and 40*s* and prevents fuel leakage at any anticipated engine operating temperature. The metallic seal member 80 can be made of a metal or alloy that can be so sealingly compressed, although the seal member 80 may be made of non-metallic material such as high temperature plastic or other non-metallic material that is deformable or pliable enough to accommodate any surface irregularities in the sealing surfaces 12*s*, 12*t*, 20*s*, 30*s*, and 40*s* and that is able to withstand seal operating temperatures up to 1250 degrees F. For example, a preferred seal member 80 is machined of commercially pure nickel, which is pliable enough to accommodate any surface irregularities in the sealing surfaces 12*s*, 12*t*, 20*s*, 30*s*, and 40*s* and which is able to withstand seal operating temperatures up to 1250 degrees F. This operable temperature compares to that for elastomer seals which usually cannot exceed 500 to 600 degrees F. in temperature.

The deformable seal member 80 is received with peripheral (radial) clearance in the shroud member 20 so as to be a close tolerance fit therein. Also, the inner nozzle body 30 is received with peripheral (e.g. radial) clearance in the shroud member 20 so as to be a close tolerance fit therein. Such fits permit the seal member 80 and inner nozzle body along with swirler body 40 to be readily removed from the nozzle tip 14 when the shroud member 20 is unthreaded from the support member 12.

Figure 6A:
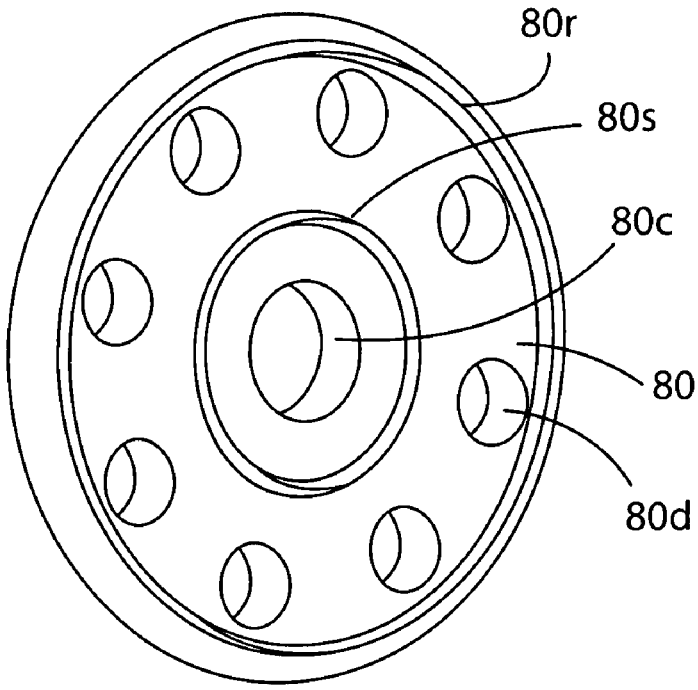
FIG. 6A is a perspective view of a deformable metallic seal member pursuant to another embodiment of the invention.
Figure 6B:
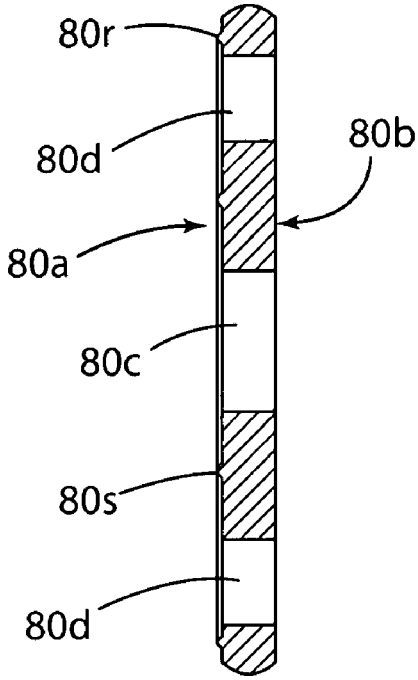
FIG. 6B is diametral sectional view of the seal member of FIG. 6A.

Referring to FIGS. 6A and 6B, an alternative deformable seal member 80 pursuant to an embodiment of the invention is provided with axially projecting, annular outer and inner sealing ribs 80*r*, 80*s* on side 80*a* to provide a more localized sealing region, similar to a knife edge, for sealingly engaging the deformable seal member 80 when assembled in the nozzle tip as shown in FIG. 1. The other side 80*b* of the deformable seal member 80 likewise can include similar axially extending, annular projecting outer and inner sealing ribs as ribs 80*r*, 80*s*.

While the invention has been described in terms of specific embodiments thereof, it is not intended to be limited thereto but rather only to the extent set forth in the following claims.

We claim:

1. A gas turbine engine fuel injector, comprising a support member and a nozzle tip connected to the support member, said nozzle tip including a shroud member connected to the support member with a deformable, removable seal member disposed between a sealing surface of the support member and a sealing surface of the shroud member, said seal member having one or more fuel passages through which fuel in one or more fuel circuits flows.

2. The fuel injector of claim 1 wherein the seal member includes multiple fuel passages and sealingly separates multiple fuel circuits from one another internally of the nozzle tip.

3. The fuel injector of claim 2 wherein the seal member also prevents external fuel leakage.

4. The fuel injector of claim 1 wherein the seal member is received with peripheral clearance in the shroud member.

5. The fuel injector of claim 1 wherein the seal member includes a major side having a projecting sealing rib.

6. The fuel injector of claim 1 wherein the seal member includes a pair of major sides each major side having a projecting sealing rib.

7. The fuel injector of claim 1 wherein the seal member comprises a metallic material, a non-metallic material, or a combination of a metallic material and non-metallic material.

8. The fuel injector of claim 1 wherein the nozzle tip further includes an inner nozzle body having a swirler body therein, said inner nozzle body being a close tolerance fit in the shroud member.

9. The fuel injector of claim 8 wherein the fuel swirler body includes a swirler slot, said swirler slot having an upstream slot wall that converges at an acute angle relative to a longitudinal axis in an axial direction toward a fuel discharge orifice.

10. The fuel injector of claim 1 wherein the shroud member includes internal threads by which it is threadably connected on an outer threaded region of the support member.

11. A gas turbine engine fuel injector, comprising a support member and a nozzle tip disposed on the support member, said nozzle tip including a shroud member connected to the support member with a deformable, removable seal member disposed between a sealing surface of the support member and a sealing surface of the shroud member, an inner nozzle body disposed in the shroud member, said inner nozzle body and said shroud member forming a first fuel discharge orifice and second discharge orifice, respectively, said seal member having a first fuel passage through which fuel in a first fuel circuit flows to the first fuel discharge orifice and a second fuel passage through which fuel in a second fuel circuit flows to the second fuel discharge orifice, said deformable seal sealingly separating the first and second fuel circuits from one another internally of the nozzle tip.

12. The fuel injector of claim 11 wherein the seal member also prevents external fuel leakage.

13. The fuel injector of claim 11 wherein the seal member includes a major side having a projecting sealing rib.

14. The fuel injector of claim 11 wherein the seal member includes a pair of major sides each major side having a projecting sealing rib.

15. The fuel injector of claim 11 wherein the seal member comprises a metallic material, a non-metallic material, or a combination of a metallic material and non-metallic material.

16. The fuel injector of claim 11 wherein the nozzle tip further includes a fuel swirler body received in the inner nozzle body.

17. The fuel injector of claim 16 wherein the inner nozzle body and the fuel swirler body each includes a sealing surface substantially coplanar with the sealing surface of the shroud member and sealingly engaged by the deformable seal member.

18. The fuel injector of claim 17 wherein the fuel swirler body includes a swirler slot, said swirler slot having an upstream slot wall that converges at an acute angle relative to a longitudinal axis in an axial direction toward a fuel discharge orifice.

19. The fuel injector of claim 11 wherein the deformable seal member is received with peripheral clearance in the shroud member.

20. A fuel injector for a gas turbine engine, comprising a nozzle tip connected to a support member and having a fuel swirler that includes a swirler slot, said swirler slot having an upstream slot wall that converges at an acute angle relative to a longitudinal axis in an axial direction toward a fuel discharge orifice of the nozzle tip to provide said swirler slot with a decreasing cross-sectional flow area in the swirler slot along its length.

21. The fuel injector of claim 20 including a plurality of said swirler slots.

22. The fuel injector of claim 20 wherein said fuel swirler comprises a swirler body received in an inner nozzle body.

23. A fuel injector for a gas turbine engine, comprising a nozzle tip connected to a support member and having a fuel swirler that includes a swirler body received in an inner nozzle body of the nozzle tip and a swirler slot in the swirler body, said swirler slot having an upstream slot wall that converges at an acute angle relative to a longitudinal axis in an axial direction toward a fuel discharge orifice of the nozzle tip to provide said swirler slot with a decreasing cross-sectional flow area along its length.

* * * * *